US008291920B2

(12) United States Patent
Takata et al.

(10) Patent No.: US 8,291,920 B2
(45) Date of Patent: Oct. 23, 2012

(54) MASCARA APPLICATOR

(75) Inventors: Motoki Takata, Yokohama (JP); Isao Yajima, Yokohama (JP)

(73) Assignee: Shiseido Co., Ltd., Chuo-ku, Tokyo (JP)

( * ) Notice: Subject to any disclaimer, the term of this patent is extended or adjusted under 35 U.S.C. 154(b) by 131 days.

(21) Appl. No.: 12/747,607

(22) PCT Filed: Nov. 20, 2008

(86) PCT No.: PCT/JP2008/071133

§ 371 (c)(1),
(2), (4) Date: Jul. 13, 2010

(87) PCT Pub. No.: WO2009/084343

PCT Pub. Date: Jul. 9, 2009

(65) Prior Publication Data

US 2010/0288296 A1 Nov. 18, 2010

(30) Foreign Application Priority Data

Dec. 27, 2007 (JP) ..... 2007-336407

(51) Int. Cl.
*A45D 40/26* (2006.01)

(52) U.S. Cl. ..... 132/218

(58) Field of Classification Search ..... 132/218, 132/320, 317; 15/160, 206, DIG. 5
See application file for complete search history.

(56) References Cited

U.S. PATENT DOCUMENTS 4,660,582 A * 4/1987 Taylor ..... 132/218
5,862,812 A 1/1999 Dumler
6,053,179 A 4/2000 Lhuisset
2002/0124860 A1 9/2002 Gueret
2002/0139385 A1* 10/2002 Gueret ..... 132/218

FOREIGN PATENT DOCUMENTS

JP 62-217903 9/1987
JP 2005-193068 7/2005
JP 2005-319004 11/2005

OTHER PUBLICATIONS

Chinese Office Action (translated in Japanese), dated Sep. 14, 2011, nine pages.
International Search Report for corresponding PCT/JP2008/071133 mailed Jan. 27, 2009, one page.

* cited by examiner

*Primary Examiner* — Rachel Steitz
(74) *Attorney, Agent, or Firm* — Rankin, Hill & Clark LLP

(57) ABSTRACT

An object of the present invention is to provide a mascara applicator capable of being fitted to the curved bases of eyelashes to lift up eyelashes, providing voluminousness to the eyelashes by adhering a mascara to the bases of the eyelashes, widely applying the mascara so that the eyelashes expand in the form of a fan, properly and widely applying the mascara to detailed parts such as the tail and inner corner of the eye, as well as lower eyelashes, and also obtaining an all direction expansion mascara application result. A mascara applicator (1), which has a long core member (2), and an application part configured by an upper application part (5) and a lower application part (6) that are supported by the core member (2), extend from the core member to the outside in a horizontal sectional direction, carry a mascara thereon, and apply the mascara to eyelashes, the lower application part being set to be shorter than the upper application part in the horizontal section, wherein a cross section of the upper application part along a longitudinal direction of an axis of the core member is shaped into a series of crests with one and half crests along the longitudinal direction between a base end part and tip part of the core member.

16 Claims, 3 Drawing Sheets

FIG. 1
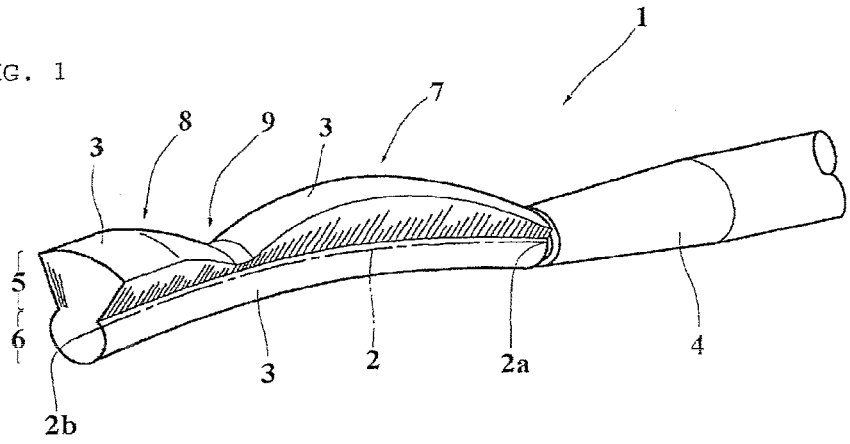
FIG. 2(a)
FIG. 2(b)
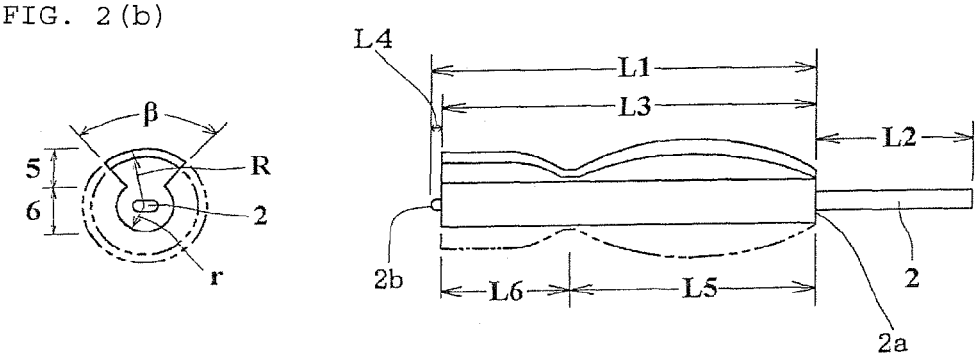
FIG. 2(c)
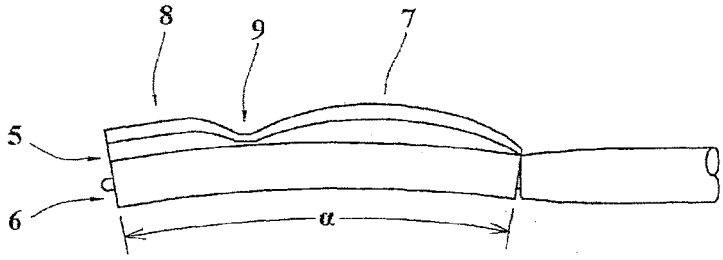

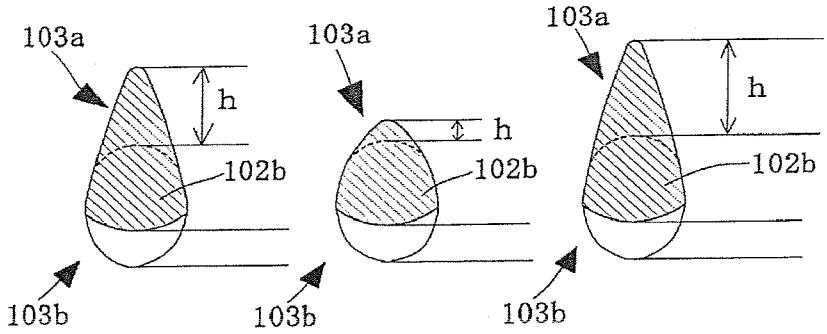
FIG. 5(a) FIG. 5(b) FIG. 5(c)
FIG. 6
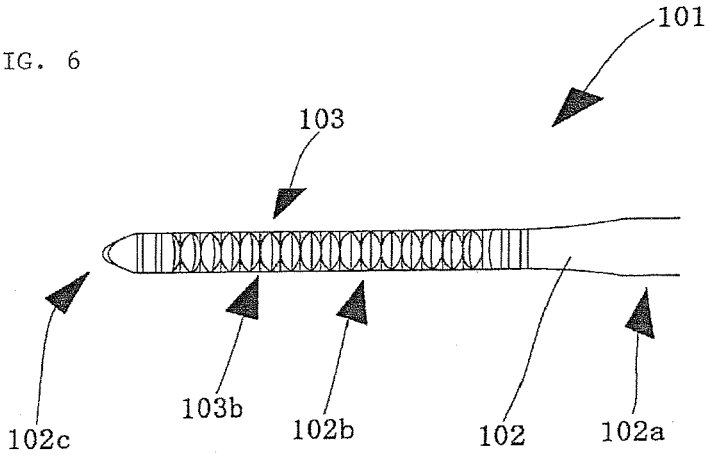

MASCARA APPLICATOR

TECHNICAL FIELD

The present invention relates to a brush-like or comb-like applicator for applying an eyelash cosmetic, such as a mascara.

BACKGROUND ART

A conventional mascara applicator for applying an eyelash cosmetic is formed by twisting a metallic core member to form a long double spiral and twisting brush fibers into the core member such that the brush fibers protrude and are held substantially radially from the core member between a base end part to a tip part of the core member.

The conventional mascara applicator also has a bundle of brush fibers that is formed in the form of a cylinder around the straight core member. In this type of an applicator, most areas on an application surface configured by the bundle of brush fibers provide substantially the same amount of mascara to be adhered [to eyelashes]. For this reason, almost the same feeling in application can be provided no matter what part [of the mascara applicator] is used [on the eyelashes], and thus obtaining a monotone result.

Due to such circumstances, various ideas were proposed in order to achieve different applications based on application sections and application steps, by forming the horizontal sectional shape crossing the longitudinal direction of the core member of the bundle of brush fibers, into a circle having the core member at the center thereof, a decentering circle, a substantially fan shape as disclosed in Patent Literature 1 or Patent Literature 2, or a shape where the application of the mascara applicator changes depending on the sections of the bundle of brush fibers, or by providing a wide application surface and a sharp application part.

In addition, in the conventional mascara applicator, as disclosed in Patent Literature 3, the external shape of the substantial cylindrical body configured by the bundle of brush fibers is so devised as to obtain easy application, by forming a circular valley part in substantially a central part in the longitudinal direction of the core member and circular crest parts in both base end part and tip part of the valley part, in accordance with the shape of an eyelid.

There is also a mascara applicator in which, instead of forming the external shape of the bundle of brush fibers into a curve, the core member that is simply formed into a straight line is formed into an arch to make the brush fibers fit to the shape of the eyelid.

Patent Literature 1: Japanese Patent Unexamined Application Publication No. S62-217903

Patent Literature 2: Japanese Patent Unexamined Application Publication No. 2003-009942

Patent Literature 3: Japanese Patent Unexamined Application Publication No. H10-080321

Incidentally, recent mascaras are required to provide voluminousness that can be observed from any angles, and a result in which the eyelashes expand in all directions to make the eye look big. In order to realize such an omni-directional expansion mascara, it is essential for this mascara to basically play the following four roles. First, the applicator needs to be fitted to the curved bases of the eyelashes to lift the eyelashes. Secondly, the mascara needs to be adhered to the bases of the eyelashes to provide voluminous eyelashes. Thirdly, the mascara needs to be applied widely so that the eyelashes expand in the form of a fan. Fourthly, the mascara needs to be applied properly and widely to the detailed parts such as the tail of the eye, the inner corner of the eye, and the lower eyelashes.

However, regarding the conventional applicator of Patent Literature 1 or 2 that has the bundle of brush fibers that is simply formed on the fan-shaped horizontal section, although the mascara can be applied to a wide region of the eyelashes using the fan-shaped outer circumferential part of the applicator, the applicator cannot be fitted to the curved bases of the eyelashes. As a result, the entire eyelashes cannot be lifted up, or a sufficient amount of mascara cannot be adhered to the bases of the eyelashes. Moreover, regarding the conventional shape of the bundle of brush fibers described in Patent Literature 3, the mascara can be applied over the region between the center of the longitudinal direction of individual eyelash and the tip of the same along the shape of the eyelid or the curved line of the bases of the eyelashes by using the wide outer circumferential surface of the curved bundle of brush fiber. However, it is impossible to adhere the mascara to the bases of the eyelashes or to lift up the eyelashes from the bases thereof.

DISCLOSURE OF THE INVENTION

The present invention has been contrived in view of the problems mentioned above, and an object thereof is to provide a mascara applicator capable of being fitted to the curved bases of eyelashes to lift up eyelashes, providing voluminousness to the eyelashes by adhering a mascara to the bases of the eyelashes, widely applying the mascara so that the eyelashes expand in the form of a fan, properly and widely applying the mascara to detailed parts such as the tail and inner corner of the eye, as well as lower eyelashes, and also obtaining an all direction expansion mascara application result.

Means employed by the present invention in order to achieve the object described above is a mascara applicator, which has a long core member, and an application part configured by an upper application part and a lower application part that are supported by the core member, extend from the core member to the outside in a horizontal sectional direction, carry a mascara thereon, and apply the mascara to eyelashes, the lower application part being set to be shorter than the upper application part in the horizontal section, wherein a cross section of the upper application part along a longitudinal direction of an axis of the core member is shaped into a series of crests with one and half crests along the longitudinal direction between a base end part and tip part of the core member.

A central part of the core member in the longitudinal direction is formed into a convex arch that is curved upward.

The application part is configured by brush fibers, which are held substantially radially in the horizontal section with the core member as the center, and each of the brush fibers of the lower application part in the horizontal section is set to be shorter than each of the brush fibers of the upper application part.

A cross section of a bundle of brush fibers of the lower application part that crosses the longitudinal direction of the core member is shaped into a substantial fan that expands outward from the core member.

A central angle of a substantial fan formed by a bundle of brush fibers of the upper application part is at least 45° but no more than 120°.

A cross section of a bundle of brush fibers of the lower application part that crosses the longitudinal direction of the core member is shaped into a substantial fan that expands outward from the core member.

A central angle of the substantial fan formed by the bundle of brush fibers of the lower application part is at least 240° but no more than 315°.

The upper and lower application parts form combs configured by fin-shaped parts formed integrally with the core member.

Each fin of the upper application part is formed into a substantially triangular flat plate in which the surface direction thereof is the longitudinal direction of the core member.

A space between the fins of the upper application part is set to at least 0.4 mm but no more than 1.0 mm.

A cross sectional shape of each fin of the lower application part along the longitudinal direction of the axis of the core member is in the form of a substantial crest, and a cross sectional shape of an entire lower fin-shaped part is formed into a series of waves.

A space between the fins of the lower application part is set to at least 0.6 mm but no more than 1.4 mm.

According to the mascara applicator of the present invention, the core member is curved into an arch, and the bristles or fins of the upper application part in an outer section of the curved core member are set to be longer than the bristles or fins of the lower application part, whereby the mascara applied to the bases of eyelashes can be spread on the entire eyelashes.

Especially because the upper application part and the lower application part are each configured into a brush of sturdy fibers and the horizontal section of the bundle of brush fibers of the upper application part is shaped into a fan, the entire eyelashes can be easily loosened and expanded omni-directionally. Moreover, when the upper application part is configured into a comb by providing a plurality of fins at intervals of approximately 0.4 mm to 1.0 mm in parallel, each of the fins being in the form of a substantially triangular flat plate, the eyelashes that are stuck to each other by the mascara applied thereto can be combed and easily separated. As a result, a very fine sense of result can be obtained.

In addition, because the bristles or fins of the lower application part are set to be shorter than the bristles or fins of the upper application part, the mascara can be applied directly to the bases of the eyelashes. Especially when the lower application part is configured such that the cross section thereof along the longitudinal direction of the axis of the core member is shaped into a series of waves, the wave-shaped lower application part can hold the mascara evenly, and consequently the mascara can be applied evenly to the bases of the eyelashes. Therefore, when spreading the mascara from the bases of the eyelashes through the tips of the eyelashes, the coagulation of the mascara can be prevented, whereby the eyelashes are prevented from sticking to each other to form a bundle.

Additionally, because the cross section of the upper application part along the longitudinal direction of the axis of the core member is shaped into a series of crests with one and half crests along the longitudinal direction of the core member between the base end part and the tip part, the upper application part of the one crest part can be used for spreading the mascara upward along the direction in which eyelashes grows, and the half crest part can be used for carefully applying the mascara to both the tail and inner corner of the eye. Furthermore, the mascara can be spread easily from the bases of the eyelashes to the tips of the same omni-directionally, and the detailed parts, such as the inner corner of the eye, the periphery of the eye, the tail of the eye, and the lower eyelashes, can be finished properly.

In other words, according to the mascara applicator of the present invention, although this is one mascara applicator, the mascara can be applied appropriately and dispersively to the bases of the eyelashes from the inner corner of the eye through the tail of the eye by using the lower application part, and the mascara applied to the bases of the eyelashes can be omni-directionally and evenly separated and expanded from the bases to the tips of the eyelashes by using the single crest part of the upper application part. Moreover, the detailed parts, such as the inner corner of the eye, the periphery of the eye, the tail of the eye, and the lower eyelashes, can be finished properly by using the half crest part of the upper application part, and as a result long, voluminous eyelashes, as well as a very fine sense of result that could not be obtained in the prior arts can be achieved. Especially when the upper application part and the lower application part are configured into combs, the core member and the application part can be formed integrally, which can reduce the production cost.

BRIEF DESCRIPTION OF THE DRAWINGS

FIG. 1 is a perspective view showing the side of a mascara applicator of Embodiment 1;

FIG. 2(*a*) is a simplified side view showing a state before bending a core member of the mascara applicator of Embodiment 1 into a circular arc, FIG. 2(*b*) is a simplified diagram showing the cross sectional shape of a bundle of brush fibers in which the mascara applicator shown in FIG. 2(*a*) is viewed from a tip thereof, and FIG. 2(*c*) is a simplified side view showing the configuration of the mascara applicator of Embodiment 1;

FIG. 5(*a*) is a cross-sectional diagram taken along a line A-A' shown in FIG. 4, FIG. 5(*b*) is a cross-sectional diagram taken along a line B-B' shown in FIG. 4, and FIG. 5(*c*) is a cross-sectional diagram taken along a line C-C' shown in FIG. 4; and FIG. 6 is a bottom view of FIG. 4.

EXPLANATION OF REFERENCE NUMERALS

Figure 3:
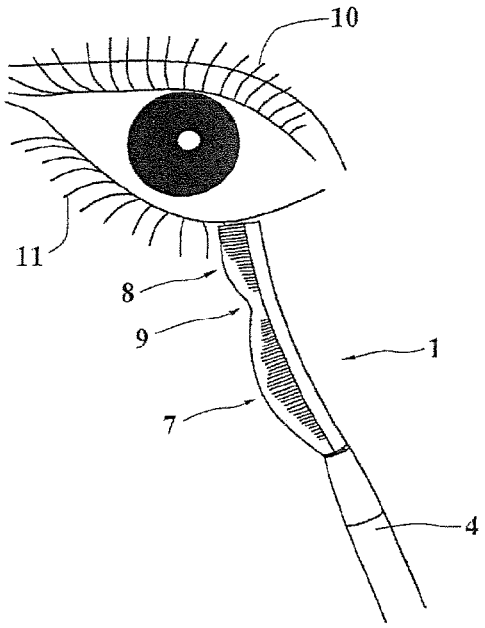
FIG. 3 is a perspective view showing how the mascara applicator of Embodiment 1 is used.

1 Mascara applicator
2 Core member
2*a* Base end part
2*b* Tip part
3 Brush fiber
4 Axial rod
5 Upper application part
6 Lower application part
7 Single crest part
8 Half crest part
9 valley part
10 Upper eyelashes
11 Lower eyelashes
101 Mascara applicator
102 Core member
102*a* Straight part
102*b* Curved part
102*c* Tip part
103 Application part
103*a* Upper fin-shaped part
103*b* Lower fin-shaped part
105 Upper application part
106 Lower application part
107 Single crest part
108 Half crest part

BEST MODE FOR CARRYING OUT THE INVENTION

Embodiments of the present invention are now described hereinafter in detail. The mascara applicator of the present embodiment is a single mascara applicator but is used for providing long, voluminous eyelashes by performing a series of operations, such as appropriately and dispersively applying the mascara to the bases of the eyelashes from the inner corner of the eye to the tail of the eye, loosening and separating the eyelashes omni-directionally and evenly from the bases to the tips of the eyelashes, and finishing the detailed parts such as the inner corner of the eye, the periphery of the eye, the tail of the eye, and the lower eyelashes.

The mascara applicator has a long core member, and an application part, which is supported by the core member, extends from the core member to the outside in a horizontal sectional direction, and carries a mascara applied to eyelashes. The application part is configured from an upper application part and a lower application part, wherein the bristles or fins of the lower application part are set to be shorter than the bristles or fins of the upper application part. The cross section of the upper application part along the longitudinal direction of an axis of the core member is shaped into a series of crests with one and half crests along the longitudinal direction between a base end part and tip part of the core member. A central part of the core member is formed into a convex arch that is curved upward.

The application part can be configured by brush fibers. When configuring the application part with brush fibers, the brush fibers are held substantially radially in a horizontal section with the core member as the center, each of the brush fibers of the lower application part in the horizontal section is set to be short, and each of the brush fibers of the upper application part is set to be long. Here, the cross section of a bundle of brush fibers of the upper application part, which crosses the longitudinal direction of the core member, is preferably formed into a substantial fan that expands outward from the core member, and, specifically, the central angle of this substantial fan is set to at least 45° but no more than 120°. The cross section of a bundle of brush fibers of the lower application part, which crosses the longitudinal direction of the core member, is preferably formed into a substantial fan that expands outward from the core member, and, specifically, the central angle of this substantial fan is set to at least 240° but no more than 315°.

The application part can also be configured into a comb having a plurality of fins formed integrally with the core member. Each fin of the upper application part is preferably formed into a substantially triangular flat plate in which the surface direction thereof is the longitudinal direction of the core member, and the space between these fins is preferably set to at least 0.4 mm but no more than 1.0 mm. In each fin of the lower application part, a cross sectional shape in a vertical section along the longitudinal direction of the axis of the core member is preferably in the form of a substantial crest, and the vertical cross sectional shape of the entire lower fin-shaped part is preferably formed into a series of waves. The space between the fins of the lower application part is preferably set to at least 0.6 mm but no more than 1.4 mm.

Embodiment 1

An embodiment of the present invention is described hereinafter in detail with reference to the drawings. A mascara applicator (1) of the present embodiment has a metallic core member (2) and brush fibers (3) held by the core member (2), wherein the core member (2) is held at a tip of a cylindrical axial rod (4) made of resin.

The core member (2) is formed by folding a straight piece of wire in half and twisting the parallel two lines of wire to form a double spiral. The bent part of the wire is obtained as the tip and the end parts of the two lines of wire are obtained as base end parts. Note that the outer diameter of the core member (2) is preferably set at approximately 1.5 mm. The part near the end part on a base end part (2*a*) of the core member (2) is inserted into a tip of the cylindrical resin axial rod (4), and the tip section of the axial rod (4) of the core member (2) is held as the base end part (2*a*) of the core member (2). As shown in FIG. 2, the length L1 between the base end part (2*a*) of the core member (2) to the tip part is preferably approximately 25±1 mm, and the length L2 of a section buried in the axial rod (4) is set at 10±1.5 mm.

Between the base end part (2*a*) to the tip part of the core member (2), the two lines of wire forming the core member (2) are twisted to form a double spiral, while the plurality of brush fibers (3) are arranged substantially evenly and perpendicular to the longitudinal direction of the core member (2), and the brush fibers (3) are sandwiched and held radially with the core member (2) as the center. Note that the length L3 of the region between the base end part (2*a*) to the tip part (2*b*) of the core member (2) where the brush fibers (3) are held is preferably 24.25 mm, and the length L4 of the region of the tip part (2*b*) of the core member (2) where the brush fibers (3) are not held is set at 0.75 mm or less.

The substantially the center of the core member (2) in its longitudinal direction is curved into an upward convex with respect to the longitudinal direction of the core member (2), so that an arch or circular arc form is obtained as a whole. Preferably, the central angle $\alpha$ of this circular arc is set at approximately 20°.

The brush fibers (3) project and are held radially from the core member (2) in the horizontal section of the core member (2), and an upper application part (5) of the brush members (3) is set to be shorter than a lower application part (6) of the brush fibers (3). In the longitudinal direction of the core member (2), a bundle of brush fibers (3) configuring the upper application part (5) is formed into a crest having one and half crests in which a single crest part (7) and a half crest part (8) are connected in series between the base end part (2*a*) and the tip part (2*b*) of the core member (2), as shown in FIGS. 1, 2(*a*) and 2(*c*). The length between the base end part (2*a*) and a valley part (9), which is a width L5 of the single crest part (7), is preferably set at 16.25 mm. A width L6 between the valley part (9) and the tip part (2*b*), which is a width L6 of the half crest part (8), is preferably at least 4 mm but no more than 12 mm, more preferably at least 6 mm but no more than 10 mm, or at 8 mm as the optimum value, because if the width is too short the mascara cannot be spread sufficiently over the eyelashes using the half crest part (8), but if the width is too long the half crest part (8) becomes too large, causing poor operability.

Moreover, as shown in FIG. 2(*b*), regarding the horizontal section of a bundle of brush fibers (3) configured by the crest part (7) and the half crest part (8) in the longitudinal direction of the core member (2), the upper application part (5) is shaped into a fan having a relatively large radius R and a small central angle $\beta$, and the lower application part (6) is shaped into a fan having a relatively small radius r and a large central angle. Preferably, the radius of the upper application part (5) at the top of the single crest part (7) is set at 4 mm, the radius of the lower application part (6) corresponding to the part immediately below [the upper application part (5)] is set to at least 1.75 mm but no more than 3 mm. Furthermore, the radius of the upper application part (5) at the top of the half crest part (8) is preferably set at 3.5 mm, and the radius of the lower application part (6) corresponding to the part immediately below [the upper application part (5)] is set to at least 1.75 mm but no more than 3 mm. Preferably, the radius r of the lower application part (6) is constant throughout the longitudinal direction of the core member (2). When the radius r of the lower application part (6) is excessively large, it is difficult to apply the mascara directly to the bases of the eyelashes, and the amount of mascara to be adhered to the eyelashes decreases. Therefore, [the radius r of the lower application part (6)] is preferably set at 1.75 mm.

Also, if the central angle β of the fan of the upper application part (5) at the single crest part (7) and the half crest part (8) is excessively small, the single crest part (7) and the half crest part (8) become less voluminous. If, on the other hand, the central angle β is excessively large, the operability becomes degraded and a very fine result cannot be obtained. Therefore, it is preferred that [the central angle β] be set to at least 45° but no more than 120° or more preferably 82.5°±7.5°.

To use the mascara applicator (1) of the present embodiment that is configured as described above, it is preferred that a curler be used for curling the eyelashes. In this manner, the mascara applicator (1) is dipped in the mascara and held such that the lower application part (6) comes into contact with the eyelashes, and then the mascara is adhered to the bases of the eyelashes. Next, the single crest part (7) of the bundle of brush fibers (3) is brought into abutment with the eyelashes, and the mascara is spread upward along the direction in which the eyelashes grow. Finally, the half crest part (8) at the tip of the bundle of the brush fibers (3) is used for applying the mascara to each side of the eyelashes, i.e., to the tail and inner corner of the eye. As a result, the application of the mascara to upper eyelashes (10) is completed.

The mascara applicator (1) of the present embodiment can be similarly used for the application of the mascara to lower eyelashes (11) as well. First, the mascara is adhered to the bases of the lower eyelashes (11). Next, the mascara applicator (1) is set vertically, and the tip of the half crest part (8) is moved from side to side and up and down to apply the mascara to the lower eyelashes (11). Finally, as shown in FIG. 3, the tip of the half crest part (8) is used to carefully apply the mascara to each side of the lower eyelashes (11), i.e., to the tail and inner corner of the eye. In this manner described above, wearing the mascara can be completed, and the long, voluminous eyelashes and very fine sense of result can be achieved.

Embodiment 2

Figure 4:
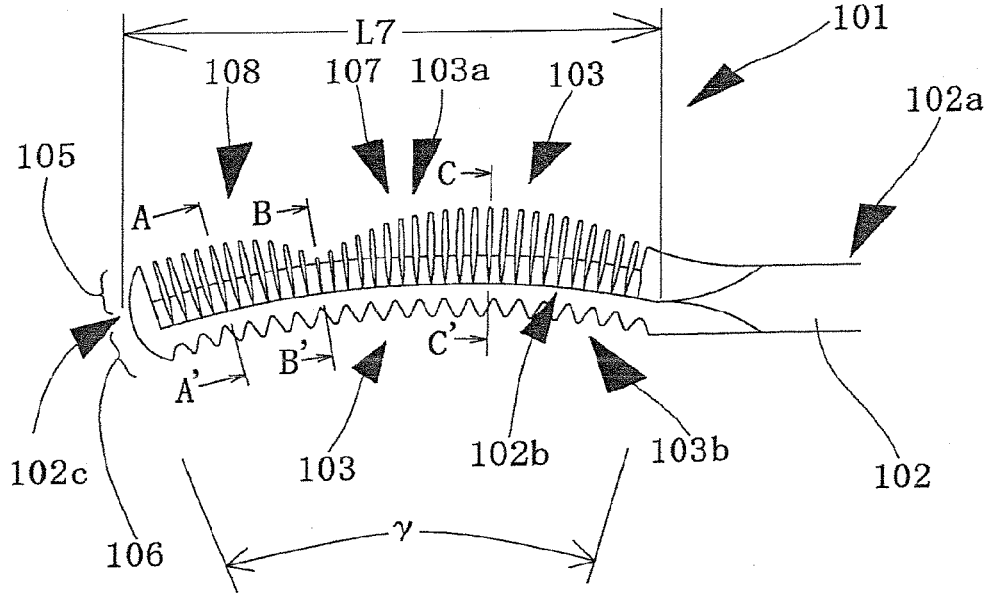
FIG. 4 is a side view showing the substantial parts of a mascara applicator of Embodiment 2.

Another embodiment of the present invention is described hereinafter in detail with reference to the drawings. A mascara applicator (101) has a resin core member (102), and an upper fin-shaped part (103*a*) and a lower fin-shaped part (103*b*), each of which is configured by a plurality of fins extending vertically from the core member (102), as shown in FIG. 4.

The core member (102) is formed to have a curved part (102*b*) that is curved into an arch, by using a conventionally known synthetic resin such as polypropylene, wherein the curved part (102*b*) is configured as the tip side and a straight part (102*a*) is configured as the base end part that is attached to a handle such as an axial rod (not shown). A tip part (102*c*) that projects in the form of a substantially semioval shape toward a tip of an axial direction of the curved part (102*b*) is formed on the tip of the curved part (102*b*) of the core member (102). Note that the outer diameter of the core member (102) is preferably set at approximately 2.5 mm. The length L7 of the curved part (102*b*) of the core member (102) is preferably set at approximately 25±1 mm, and the length of the straight part (not shown) is preferably set at 35±1.5 mm.

The substantially the center of the curved part (102*b*) of the core member (102) is curved upward into a convex shape with respect to the longitudinal direction of the curved part (102*b*), so that a gentle arch or circular arc form is obtained as a whole. Preferably, the central angle y of this arch or circular arc is set at approximately 30°.

An upper application part (105) of the curved part (102*b*) of the core member (102) is configured into a comb by arranging a plurality of flat fins vertically upward in relation to the longitudinal direction of the curved part (102*b*) at substantially equal spaces, integrally with the core member (102). The fins of the upper application part (105) are each formed into a substantially flat triangle having an apex at its top, wherein the longitudinal direction of the curved part (102*b*) is taken as a surface direction. The space between the fins of the upper application part (105) is set to at least 0.4 mm but no more than 1.0 mm. Regarding the fins of the upper application part (105), tall fins and short fins are arrayed in appropriate order, such that a virtual curve C connecting the tips of the fins forms a crest having a series of one and half crests in which a single crest part (107) and half crest part (108) are connected between an end part on the base end part of the curved part (102*b*) and the tip of the curved part (102*b*). Note that the height h of a fin of the upper fin-shaped part (103*a*) of the present embodiment is 0.3 to 1.0 mm at a minimum (FIGS. 5*b*) and 2 to 3 mm at a maximum (FIG. 5*c*).

A lower application part (106) of the curved part (102*b*) of the core member (102) is configured into a comb by arranging a plurality of fins vertically downward in relation to the longitudinal direction of the curved part (102*b*) at substantially equal spaces, integrally with the core member (102). The vertical section of each fin of the lower application part (106) along the longitudinal direction of the axis of the curved part (102*b*) is shaped into a substantial crest having an apex at its bottom. The space between the fins of the lower application part (106) is set to at least 0.6 mm but no more than 1.4 mm. Although the height of the fins of the lower application part (106) are substantially equal to each other and set at approximately 1.0 mm, the height of the fins in the vicinity of the end part on the base end side of the curved part (102*b*) and in the vicinity of the tip of the curved part (102*b*) are set to be relatively low, due to the shallow roundness of the valley parts of these fins. Therefore, the lower fin-shaped part (103*b*) is configured such that the vertical section of the entire lower fin-shaped part (103*b*) along the longitudinal direction of the axis of the curved part (102*b*) is shaped into a series of waves. In other words, the lower fin-shaped part (103*b*) of the lower application part (106) shown in the bottom view of the curved part (102*b*) of the core member (102) has a substantially rugby ball-like shape that has a vertical centerline, as shown in FIG. 6. Moreover, the width of the lower fin-shaped part (103*b*) of the lower application part (106) becomes the maximum in the vicinity of the uppermost part thereof, and the size of this maximum width is set to be substantially equal to the diameter of the curved part (102*b*) of the core member (102).

The method of using the mascara applicator (101) of the present embodiment that is configured as described above is substantially the same as that of the mascara applicator (1) of Embodiment 1. For the mascara applicator (101) of the present embodiment, the application part (103) is configured into a comb having a plurality of fins that are formed at appropriate equal spaces. Thus, by loosening the eyelashes that are applied with the mascara by using the comb-shaped application part (103), the eyelashes that are stuck to each other can be separated, whereby a finer sense of result of eyelashes that are almost real eyelashes can be obtained.

The invention claimed is:

1. A mascara applicator, including a long core member, and an application part comprising an upper application part and a lower application part that are supported by the core member, wherein the application part extends from the core member to the outside in a cross sectional direction of the core member perpendicular to a longitudinal direction of an axis of the core member, wherein the application part carries a mascara thereon, and wherein the application part can be used to apply the mascara to eyelashes, wherein the lower application part is shorter than the upper application part in the cross sectional direction of the core member perpendicular to the longitudinal direction of the axis of the core member, wherein a cross section of the upper application part along the longitudinal direction of the axis of the core member is shaped into a series of crests with one and a half crests along the longitudinal direction between a base end part and tip part of the core member, the half crest being disposed at the end of the mascara applicator, a cross section of the upper application part perpendicular to the longitudinal direction of the axis of the core member has a fan-shape, and the application part is formed by brush fibers.

2. The mascara applicator of claim 1, wherein a central part of the core member in the longitudinal direction is formed into a convex arch that is curved upward.

3. The mascara applicator of claim 1, wherein a central angle of the substantial fan formed by the bundle of brush fibers of the upper application part is at least 45° but no more than 120°.

4. The mascara applicator of claim 3, wherein a cross section of a bundle of brush fibers of the lower application part that crosses the longitudinal direction of the core member is shaped into a substantial fan that expands outward from the core member.

5. The mascara applicator of claim 1, wherein a cross section of a bundle of brush fibers of the lower application part that crosses the longitudinal direction of the core member is shaped into a substantial fan that expands outward from the core member.

6. The mascara applicator of claim 5, wherein a central angle of the substantial fan formed by the bundle of brush fibers of the lower application part is at least 240° but no more than 315°.

7. The mascara applicator of claim 1, wherein a cross section of a bundle of brush fibers of the lower application part that crosses the longitudinal direction of the core member is shaped into a substantial fan that expands outward from the core member.

8. The mascara applicator of claim 1, wherein a highest portion of the cross sectional shape of the half crest is disposed at the end of the mascara applicator.

9. A mascara applicator, including a long core member, and an application part comprising an upper application part and a lower application part that are supported by the core member, wherein the application part extends from the core member to the outside in a cross sectional direction of the core member perpendicular to a longitudinal direction of an axis of the core member, wherein the application part carries a mascara thereon, and wherein the application part can be used to apply the mascara to eyelashes, wherein the lower application part is shorter than the upper application part in the cross sectional direction of the core member perpendicular to the longitudinal direction of the axis of the core member, wherein a cross section of the upper application part along the longitudinal direction of the axis of the core member is shaped into a series of crests with one and a half crests along the longitudinal direction between a base end part and tip part of the core member, the half crest being disposed at the end of the mascara applicator, and, wherein the upper and lower application parts form combs comprising fin-shaped parts formed integrally with the core member.

10. The mascara applicator of claim 9, wherein a central part of the core member in the longitudinal direction is formed into a convex arch that is curved upward.

11. The mascara applicator of claim 9, wherein each fin of the upper application part is formed into a substantially triangular flat plate having an apex on an upper side in which the surface direction of the flat plate is the longitudinal direction of the core member.

12. The mascara applicator according to claim 11, wherein a space between the fins of the lower application part is from 0.6 mm to 1.4 mm.

13. The mascara applicator of claim 9 or 11, wherein a space between the fins of the upper application part is from 0.4 mm to 1.0 mm.

14. The mascara applicator of claim 9, wherein a cross sectional shape of each fin of the lower application part along the longitudinal direction of the axis of the core member is in the form of a substantial crest, and a cross sectional shape of an entire lower fin-shaped part is formed into a series of waves.

15. The mascara applicator according to claim 9, wherein a space between the fins of the lower application part is from 0.6 mm to 1.4 mm.

16. The mascara applicator of claim 9, wherein a highest portion of the cross sectional shape of the half crest is disposed at the end of the mascara applicator.

* * * * *